US008829404B1

(12) United States Patent
Rinker

(10) Patent No.: US 8,829,404 B1
(45) Date of Patent: Sep. 9, 2014

(54) MULTI-MODE SEEKERS INCLUDING FOCAL PLANE ARRAY ASSEMBLIES OPERABLE IN SEMI-ACTIVE LASER AND IMAGE GUIDANCE MODES

(75) Inventor: Robert Rinker, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 885 days.

(21) Appl. No.: 13/022,104

(22) Filed: Feb. 7, 2011

Related U.S. Application Data

(60) Provisional application No. 61/317,923, filed on Mar. 26, 2010.

(51) Int. Cl.
*G01C 21/02* (2006.01)
*F41G 7/22* (2006.01)

(52) U.S. Cl.
CPC ..... *F41G 7/2246* (2013.01)
USPC ..... 250/203.1; 250/214 R

(58) Field of Classification Search
USPC ..... 250/203.1, 203.6, 208.1, 214.1, 214 R; 356/4.01–4.03, 512, 515, 141.1; 244/3.11–3.17, 3.3
See application file for complete search history.

(56) References Cited

U.S. PATENT DOCUMENTS

| | | | | |
|---|---|---|---|---|
| 6,111,241 | A | 8/2000 | English et al. | |
| 6,323,941 | B1 | 11/2001 | Evans | |
| 6,606,066 | B1 | 8/2003 | Fawcett et al. | |
| 6,864,965 | B2 | 3/2005 | DeFlumere | |
| 6,924,772 | B2 | 8/2005 | Kiernan, Jr. et al. | |
| 8,207,481 | B2 * | 6/2012 | Taylor et al. | 244/3.16 |
| 2004/0004707 | A1 | 1/2004 | DeFlumere | |
| 2009/0228159 | A1 | 9/2009 | Flowers | |

FOREIGN PATENT DOCUMENTS

EP 2161533 A1 3/2010

* cited by examiner

*Primary Examiner* — Que T Le
(74) *Attorney, Agent, or Firm* — Eric A. Gifford

(57) ABSTRACT

Embodiments of a multi-mode seeker are provided for use in conjunction with a predetermined laser designator. In one embodiment, the multi-mode seeker includes a focal plane array and a bi-modal processing system. The focal plane array includes a detector array and a Read-Out Integrated Circuit (ROIC) operatively coupled to the detector array. The bi-modal processing system is operatively coupled to ROIC and is switchable between: (i) an imaging mode wherein the bi-modal processing system generates video data as a function of signals received from ROIC indicative of irradiance across the detector array, and (ii) a semi-active laser guidance mode wherein the bi-modal processing system generates line-of-sight data as a function of signals received from ROIC indicative of laser pulses detected by the detector array and qualified as corresponding to the predetermined laser designator.

20 Claims, 9 Drawing Sheets

MULTI-MODE SEEKERS INCLUDING FOCAL PLANE ARRAY ASSEMBLIES OPERABLE IN SEMI-ACTIVE LASER AND IMAGE GUIDANCE MODES

CROSS REFERENCE TO RELATED APPLICATION

This application claims priority to U.S. Provisional Application Ser. No. 61/317,923, filed Mar. 26, 2010, the entire contents of which are hereby incorporated by reference.

TECHNICAL FIELD

The following disclosure relates generally to homing guidance systems and, more specifically, to embodiments of a multi-mode seeker including a dual function focal plane array device operable in both imaging and semi-active laser guidance modes.

BACKGROUND

Munition guidance systems have evolved considerably since the initial introduction of heat-seeking missiles in the late 1950's. Missiles, rockets, and other munitions are now commonly equipped with advanced homing guidance systems referred to as "seekers." Modern seekers often include two or three independent detector subsystems, which each support a different guidance modality. These detector subsystems are independent in the sense that each subsystem includes at least one dedicated electro-optic sensor (e.g., a detector array sensitive to wavelengths in the visible or infrared spectrum) positioned within a distinct focal plane. Additionally, each detector subsystem typically includes a separate, dedicated processor, which processes signals provided by the subsystem's detector array indicative of registered electromagnetic energy. Each detector subsystem then supplies this data to a main navigational computer (commonly referred to as the "mission computer") deployed onboard the guided munition. The navigational computer utilizes the data supplied by the seeker subsystems, often in combination with data generated by other systems deployed onboard the munition (e.g., a global positioning system and an inertial navigational system) and possibly telemetry data provided by external control sources, to determine the manner in which one or more flight control surfaces should be manipulated to provide aerodynamic guidance to the munition during flight.

The independent guidance systems employed by dual- and tri-mode seekers commonly include separate infrared imaging and Semi-Active Laser ("SAL") subsystems. Conventionally-implemented infrared imaging systems often include a detector array containing a relatively high number of detector cells (e.g., a 640×480 cell grid) fabricated from a detector material (e.g., HgCdTe and InSB) sensitive to infrared energy within the thermal bands (i.e., mid- to long-wave infrared energy). A single read-out integrated circuit is positioned behind the detector array and, during seeker operation, transmits signals indicative of the irradiance received across the detector array to a dedicated imaging processor. The processor then compiles the irradiance data to produce a composite intensity image of the seeker's field-of-view, which is supplied to the munition's main navigational computer for image-based guidance purposes. By comparison, a conventionally-implemented SAL subsystem typically includes a separate detector array comprised of a relatively small number of detector cells (e.g., four wedge-shaped cells, which collectively form a four-quadrant circular detector array).

Analog circuitry operably coupled to each of the detector cells detects photocurrents induced by photons striking the detector array and supplies corresponding signals to a dedicated temporal processor. The temporal processor then compares intensity ratios across the detector cells to determine the centroid of any detected laser spot, which is provided to the main navigational computer as line-of-sight guidance data.

There is a continual demand to reduce the complexity, part count, weight, envelope, and cost of the various components (e.g., optical components, sensors, digital and analog processing elements, etc.) included within multi-mode seekers while maintaining or improving the seeker's guidance capabilities. More specifically, there exists an ongoing need to provide embodiments of a multi-mode seeker that reliably provides both imaging and Semi-Active Laser guidance capabilities with fewer components, with an enhanced reliability, and with an improved accuracy. Embodiments of such a multi-mode seeker are provided herein. Other desirable features and characteristics of the present invention will become apparent from the subsequent Detailed Description and the appended Claims, taken in conjunction with the accompanying Drawings and this Background.

BRIEF SUMMARY

Embodiments of a multi-mode seeker are provided for use in conjunction with a predetermined laser designator. In one embodiment, the multi-mode seeker includes a focal plane array and a bi-modal processing system. The focal plane array includes a detector array and a Read-Out Integrated Circuit (ROIC) operatively coupled to the detector array. The bi-modal processing system is operatively coupled to ROIC and is switchable between: (i) an imaging mode wherein the bi-modal processing system generates video data as a function of signals received from ROIC indicative of irradiance across the detector array, and (ii) a semi-active laser guidance mode wherein the bi-modal processing system generates line-of-sight data as a function of signals received from ROIC indicative of laser pulses detected by the detector array and qualified as corresponding to the predetermined laser designator.

Embodiments of a guided munition configured to be utilized in conjunction with a predetermined laser designator are further provided. In one embodiment, the guided munition includes a multi-mode seeker and a main navigational computer. The multi-mode seeker includes, in turn, a bi-modal processing system and a focal plane array, which has a detector array and a Read-Out Integrated Circuit (ROIC) operatively coupled to the detector array. The bi-modal processing system is operatively coupled to ROIC and is switchable between: (i) an imaging mode wherein the bi-modal processing system generates video data as a function of signals received from ROIC indicative of irradiance across the detector array, and (ii) a semi-active laser guidance mode wherein the bi-modal processing system generates line-of-sight data as a function of signals received from ROIC indicative of laser pulses registered by the detector array and qualified as corresponding to the predetermined laser designator. The main navigational computer is coupled to an output of the bi-modal processing system and is configured to receive therefrom video data when the bi-modal processing system is operating in the imaging mode and line-of-sight data when the bi-modal processing system is operating in the semi-active laser guidance mode.

BRIEF DESCRIPTION OF THE DRAWINGS

At least one example of the present invention will hereinafter be described in conjunction with the following figures, wherein like numerals denote like elements, and.

DETAILED DESCRIPTION

The following Detailed Description is merely exemplary in nature and is not intended to limit the invention or the application and uses of the invention. Furthermore, there is no intention to be bound by any theory presented in the preceding Background or the following Detailed Description. As appearing herein, the term "bi-modal processing system" is utilized to denote a processing system operable in at least two different processing modes (e.g., in semi-active laser and image guidance modes) and is defined to include processing systems operable in three or more processing modes.

Embodiments of a multi-mode seeker having Semi-Active Laser ("SAL") and image tracking guidance capabilities are provided. Embodiments of the multi-mode seeker may also include one or more other guidance functionalities in addition to SAL and image guidance functionalities; however, this is by no means necessary. As a specific example, the multi-mode seeker may assume the form of a dual-mode seeker having only SAL and image guidance functionalities. Alternatively, and as a second example, embodiments of the multi-mode seeker may assume the form of a tri-mode seeker having SAL and image guidance functionalities further paired with a third guidance functionality, such as radiofrequency guidance. In contrast to traditional multi-mode seekers having image tracking and SAL guidance capabilities, embodiments of the inventive multi-mode seeker utilize a single optical train, a single focal plane array, and a single processing train to perform both image and SAL tracking functionalities, which allows a significant reduction in cost, part count, weight, and envelope of the seeker, as described more fully below.

Embodiments of the multi-mode seeker system are well-suited for utilization within or use in conjunction with Laser Detection and Ranging ("LADAR") systems deployed aboard precision, small form-factor airborne munitions and sub-munitions. This notwithstanding, embodiments of the multi-mode seeker are by no means limited to deployment aboard airborne munitions and sub-munitions. A non-exhaustive list of additional platforms and vehicles on which embodiments of the multi-mode seeker can be deployed or with which embodiments of the seeker can be utilized includes Airborne Targeting Systems, Ground Vehicles, Autonomous (Robotic) Systems, and Unmanned Aerial Vehicles included within Unmanned Aircraft Systems.

Figure 1:
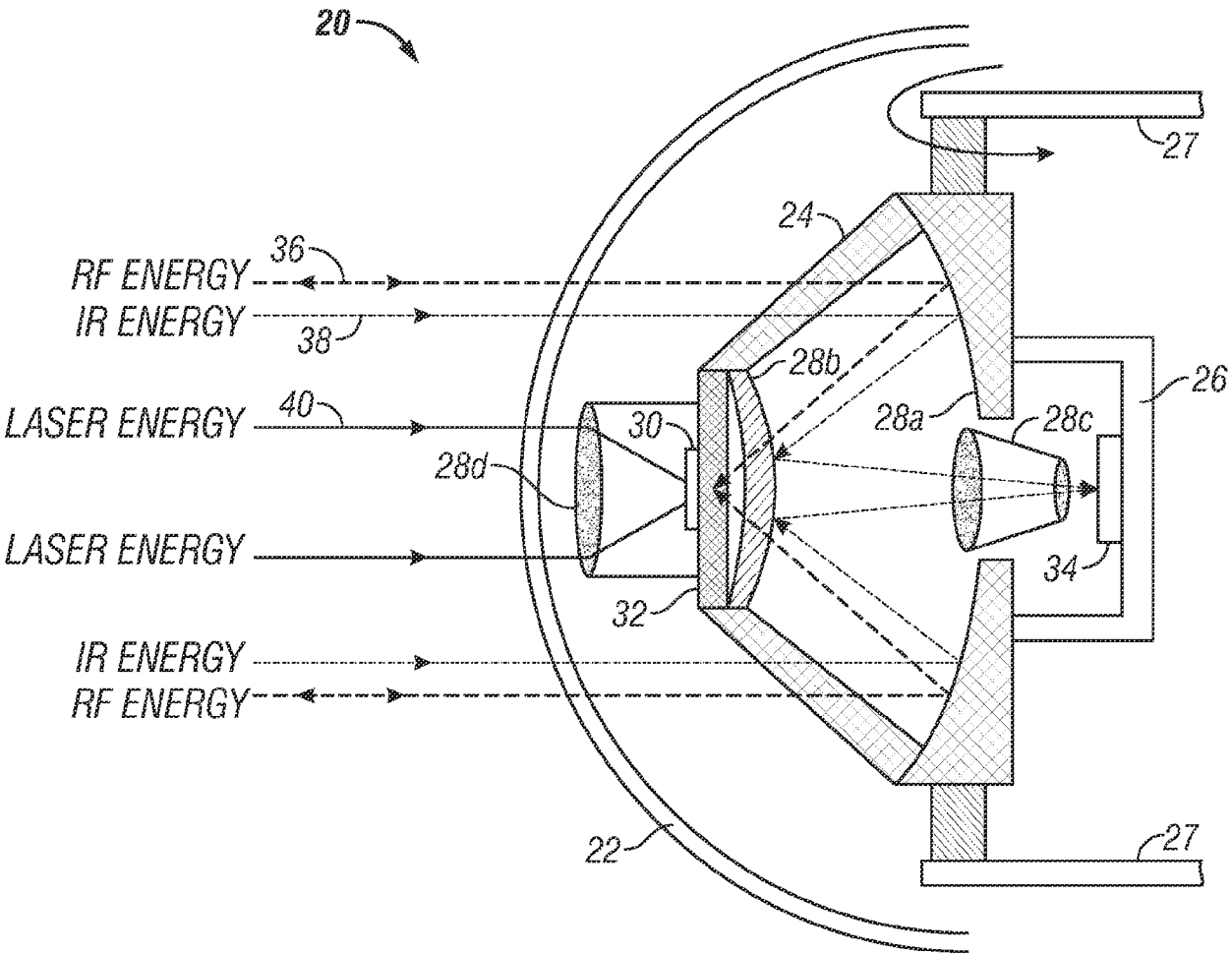
FIG. 1 (Prior Art)
FIG. 1 is a simplified cross-sectional view of a tri-mode seeker illustrated in accordance with the teachings of prior art and including independent Semi-Active Laser ("SAL") and image guidance subsystems.

FIG. 1 is a simplified cross-sectional view of a tri-mode seeker 20 illustrated in accordance with a commonly-implemented, conventionally-known design and provided for comparison purposes. Tri-mode seeker 20 includes a seeker dome 22, a gimbal assembly 24, and a number of optical components 28. Gimbal assembly 24 is rotatably coupled to a focal plane support structure 27, which is, in turn, mounted to the body or airframe of a guided munition (not shown). Tri-mode seeker 20 is further equipped with three independent guidance subsystems, which each support a different guidance functionality of seeker 20. In particular, tri-mode seeker 20 includes: (i) a Semi-Active Laser ("SAL") subsystem 30, (ii) a radiofrequency ("RF") subsystem 32, and (iii) an infrared ("IR") subsystem 34. As generally shown in FIG. 1, SAL subsystem 30 is mounted to gimbal assembly 24 and housed within a forward portion of seeker dome 22. In a similar manner, RF subsystem 32 is mounted to gimbal assembly 24 immediately behind (i.e., to the aft of) SAL subsystem 30. Lastly, IR subsystem 34 is mounted to an optical bench 26 included within an aft portion of gimbal assembly 24. SAL subsystem 30 and IR subsystem 34 are further described in conjunction with FIG. 2 below.

In the exemplary embodiment shown in FIG. 1, optical components 28 include a primary mirror 28(*a*), a secondary dichroic mirror 28(*b*), and two focal lens 28(*c*) and 28(*d*). During operation of seeker 20, optical components 28 guide electromagnetic radiation received through seeker dome 22 along three different optical paths and to the detectors of subsystems 30, 32, and 34. As indicated in FIG. 1 by dashed line 36, radiofrequency energy received through seeker dome 22 is guided along a first optical path and ultimately focused on the sensor of RF subsystem 32 by primary mirror 28(*a*). Similarly, as indicated in FIG. 1 by dot-dashed line 38, infrared energy received through dome 22 is guided by along a second optical path by mirror 28(*a*) and 28(*b*) and is ultimately focused on the detector array of IR subsystem 34 by focal lens 28(*c*). Finally, as indicated in FIG. 1 by solid line 40, laser pulse energy received through seeker dome 22 is focused on the detector array of SAL subsystem 30 by focal lens 28(*d*).

Figure 2:
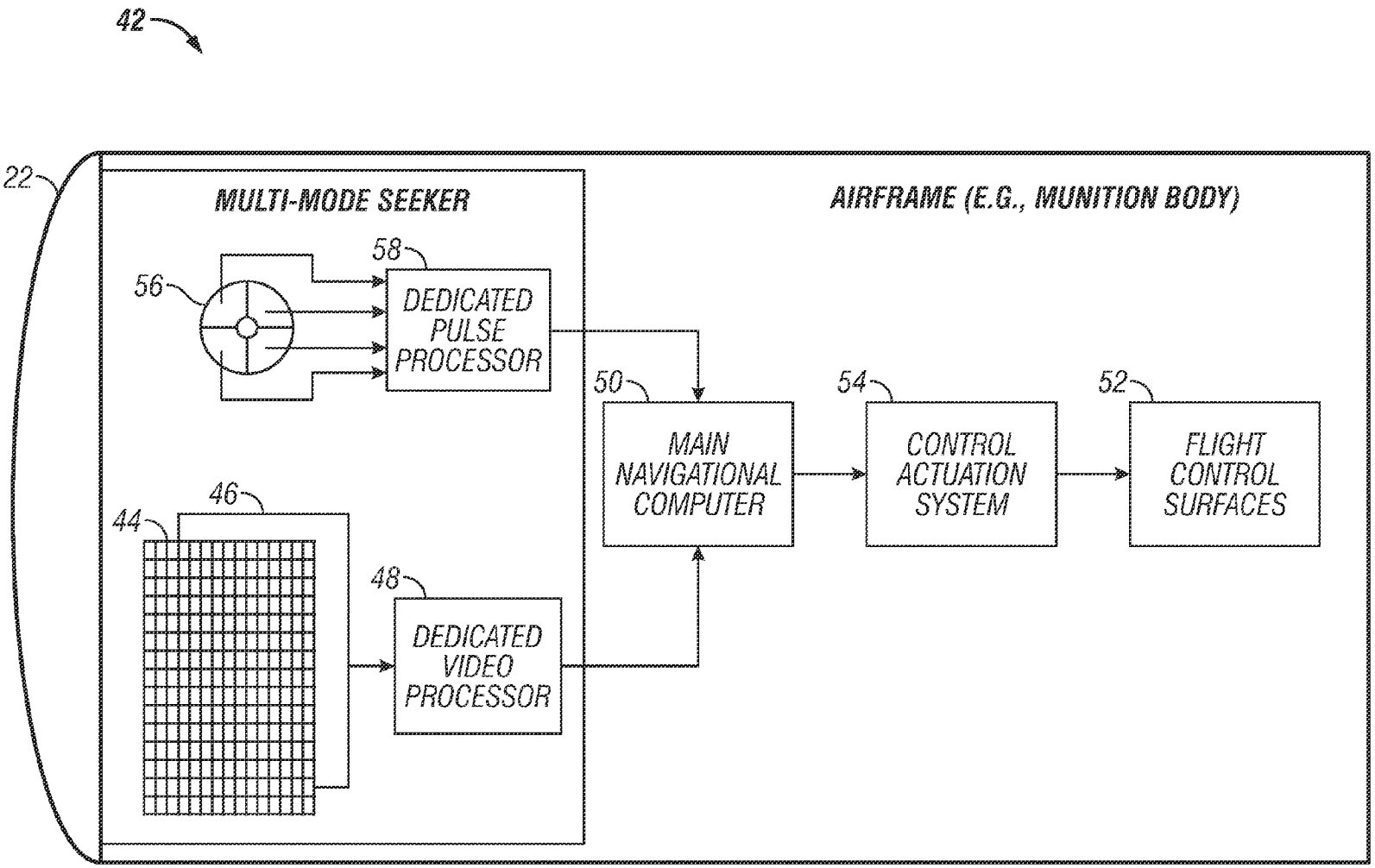
FIG. 2 (Prior Art)
FIG. 2 is a simplified block diagram of a guided munition equipped with the tri-mode seeker shown in FIG. 1.

FIG. 2 is a simplified block diagram illustrating tri-mode seeker 20 deployed onboard a generalized guided munition 42, such as a guided missile. Certain components are omitted from FIG. 2 for clarity including gimbal assembly 24, focal plane support structure 27, optical components 28, and RF subsystem 32. As can be seen in FIG. 2, SAL subsystem 30 includes a detector array 44; a Read-Out-Integrated-Circuit ("ROIC") 46, which is operatively coupled to and positioned immediately behind detector array 44; and a dedicated video processor 48, which is operably coupled to an output of ROIC 46. In one common implementation, detector array 44 comprises a relatively high number of detector cells (e.g., a 640× 480 cell grid) fabricated from a detector material (e.g., HgCdTe or Insb) sensitive to infrared energy within the thermal bands (i.e., mid- to long-wave infrared energy). During operation of seeker 20, and as generally described in the foregoing section entitled "Background," ROIC 46 transmits signals indicative of the irradiance received across detector array 44 to video processor 48. Processor 48 then compiles the irradiance data to produce a composite intensity image of the seeker's field-of-view, which is then supplied to a main navigational computer 50 deployed onboard munition 42. Main navigational computer 50 utilizes this data, in combination with data provided by other sources (e.g., data provided by RF subsystem 32 shown in FIG. 1, data provided by an onboard GPS device, data provided by an onboard inertial guidance system, telemetry data, and so on), to determine the manner in which a plurality of flight control surfaces 52 (e.g., fins, canards, and/or wings) should be manipulated to provide aerodynamic guidance to munition 42 during flight. After determining the appropriate adjustments to provide the desired guidance, main navigational computer 50 then commands a control actuation system 54 to implement the determined adjustments to flight control surfaces 52.

In the exemplary embodiment illustrated in FIGS. 1 and 2, and referring specifically to FIG. 2, SAL subsystem 30 includes a four-quadrant detector array 56 and a dedicated pulse processor 58, which is coupled to each of the cells or quadrants included within array 56. During operation of seeker 20, analog circuitry associated with array 56 (not shown) detects photocurrents induced by photons striking detector array 56 and supplies corresponding signals to a pulse processor 58. Pulse processor 58 then compares intensity ratios across the detector cells to determine the centroid of a detected laser spot and thereby provide line-of-sight guidance data to main navigational computer 50. Computer 50 then utilizes this line-of-sight guidance data, in combination with the other data sources described above, to determined the manner in which flight control surfaces 52 should be manipulated to provide aerodynamic guidance to munition 42 in the above described manner.

Conventional multi-mode seekers, such tri-mode seeker 20, have been extensively engineered and are cap providing reliable and highly accurate guidance during munition flight. However, conventionally-implemented multi-mode seekers remain limited in certain respects. For example, the provision of two separate guidance subsystems in the case of dual-mode seekers and the provision of three separate guidance subsystems in the case of tri-mode seekers (e.g., in the case of tri-mode seeker 20, the provision of SAL subsystem 30 shown in FIGS. 1 and 2, RF subsystem 32 shown in FIG. 1, and IR subsystem 34 shown in FIGS. 1 and 2) adds undesired complexity, cost, weight, and bulk to seeker. To overcome these limitations, the following describes exemplary embodiments of a multi-mode seeker, such as dual- or tri-mode seeker, employing a dual function focal plane array and a bi-modal processing system that cooperate or combine to provide both image guidance and SAL guidance functionalities.

Figure 3:
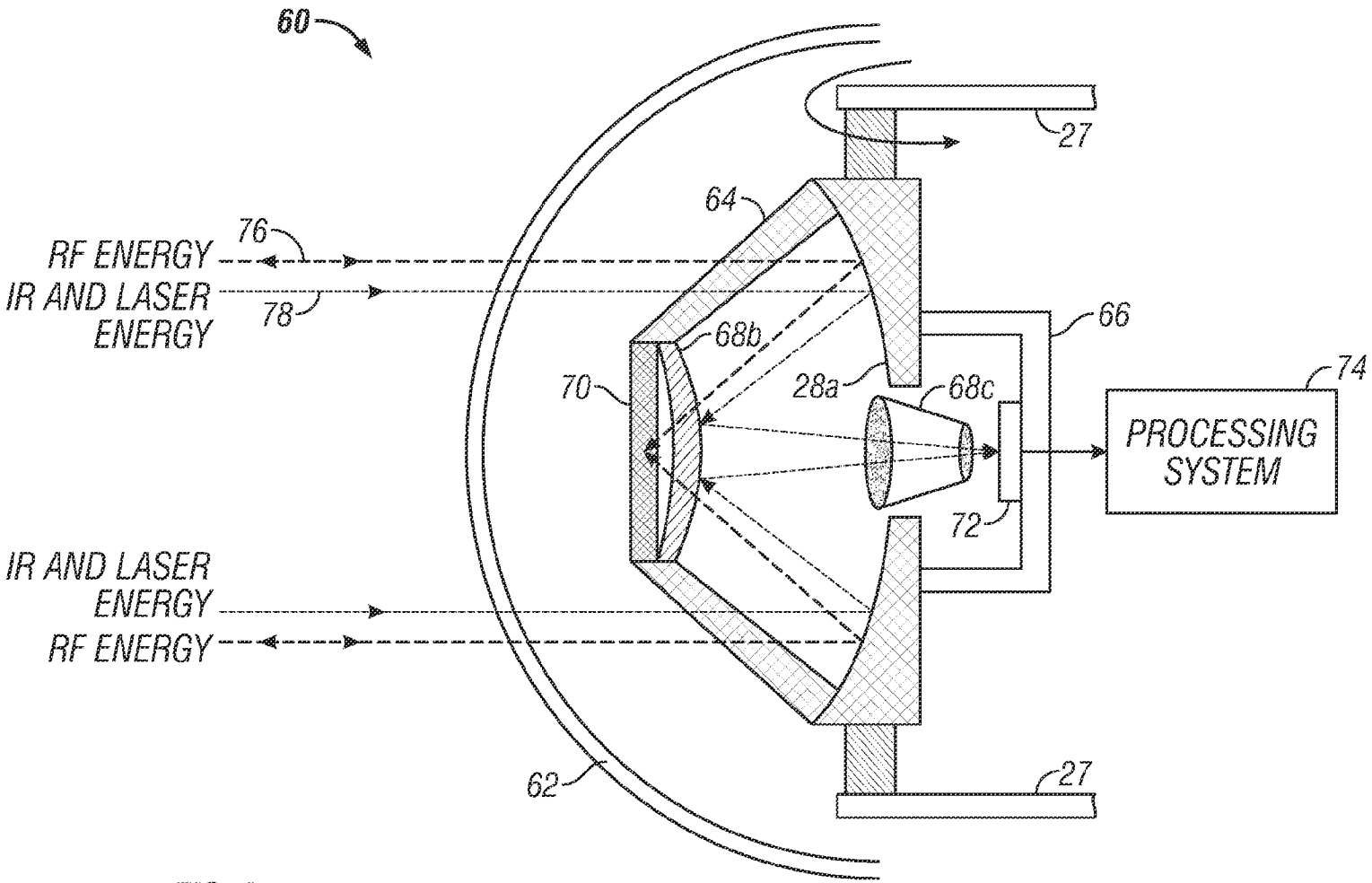
FIG. 3 is a simplified cross-sectional view of a tri-mode seeker illustrated in accordance with an exemplary embodiment of the present invention and including a dual function focal plane array capable of providing both SAL and image guidance functionalities.

FIG. 3 is a simplified cross-sectional view of a tri-mode seeker 60 illustrated in accordance with an exemplary embodiment of the present invention. In certain respects, tri-mode seeker 60 is similar to seeker 20 described above in conjunction with FIGS. 1 and 2. For example, as does seeker 20 (FIGS. 1 and 2), tri-mode seeker 60 includes a seeker dome 62, a gimbal assembly 64, and a number of optical components 68. As was the case previously, gimbal assembly 64 is rotatably coupled to a focal plane support structure 67, which is mounted to the body or airframe of a guided munition (e.g., airframe 82 shown in FIG. 4). However, in contrast to seeker 20, tri-mode seeker 60 includes only two discrete guidance subsystems: (i) a RF subsystem 70, and a (ii) a dual function imaging/Semi-Active Laser ("SAL") guidance subsystem 72, 74. Dual function imaging/SAL guidance subsystem 72, 74 includes, in turn, a dual function focal plane array ("FPA") 72 and a bi-modal processing system 74. As shown in FIG. 3, dual function FPA 72 may be mounted to an optical bench 66 included within an aft portion of gimbal assembly 64, and RF subsystem 70 may be mounted to a forward portion of gimbal assembly 24. Dual function FPA 72 and bi-modal processing system 74 are each described in detail below; a detailed discussion of RF subsystem 70 is not provided herein, however, as the implementation and functioning of RF sensors and systems (e.g., Ka-band radar systems) are well-known within the aerospace and munition industries.

During operation of seeker 60, optical components 68 guide electromagnetic radiation received through seeker dome 22 along two different optical paths and to subsystems 70 and 72, 74. In the exemplary embodiment illustrated in FIG. 3, optical components include a primary mirror 68(*a*), a secondary dichroic mirror 68(*b*), and a focal lens 68(*c*). As indicated in FIG. 3 by dot-dashed line 78, both imaging energy and laser pulse energy received through seeker dome 62 is reflected from primary mirror 68(*a*), is reflected from dichroic secondary mirror 68(*b*), and is ultimately focused by lens 68(*c*) on the detector array included within dual function FPA 72. By comparison, radiofrequency energy is received through seeker dome 62 is reflected from a primary mirror 68(*a*), propagates through a dichroic secondary mirror 68(*b*), and is ultimately focused onto the detector included within RF subsystem 70, as indicated in FIG. 3 by dashed line 76.

The structural features and functionality of exemplary dual function imaging/SAL guidance subsystem 72, 74 will be described in detail below in conjunction with FIG. 4. However, at this juncture in the description, it is useful to note that several benefits have been achieved by combining imaging and SAL guidance functionalities into a single, bi-modal subsystem. First, as may be appreciated by comparing FIG. 3 to FIG. 1, an optical component (i.e., focal lens 28(*d*)) and a detector subsystem (i.e., SAL subsystem 30) have been eliminated from tri-mode seeker 60 thereby reducing the overall weight, cost, and part count of seeker 60 relative to conventional seeker 20. Second, due to the elimination of focal lens 28(*d*) and SAL subsystem 30 (FIG. 1), a considerable volume of space has been made available in the forward nose of seeker 62. This newly-freed space is of significant value in the context of munition design and can be utilized in a variety of different manners; e.g., the size, and therefore the capabilities, of RF subsystem 70 can be increased, RF subsystem 70 can be provided with a plurality of forward-extending cooling fins (not shown), one or more additional components (e.g., an illuminator) can be incorporated into seeker 60 immediately forward of RF subsystem 70, and/or the overall dimensions of seeker 62 can be reduced.

Figure 4:
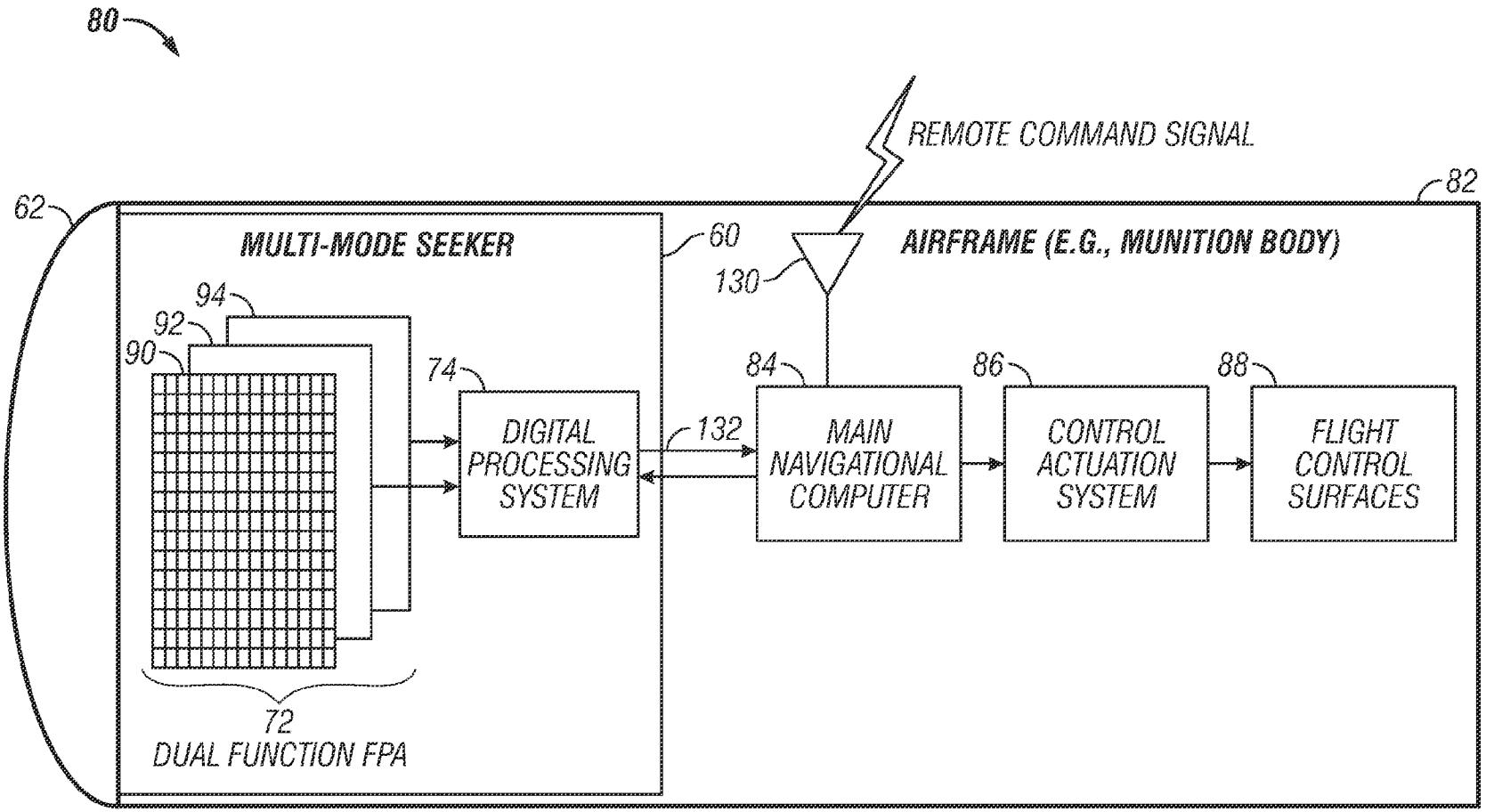
FIG. 4 is a simplified block diagram of a guided munition equipped with the tri-mode seeker shown in FIG. 3.

FIG. 4 is a simplified block diagram illustrating tri-mode seeker 60 deployed onboard a generalized guided munition 80, such as a guided missile, in accordance with a further exemplary embodiment. Certain components are omitted from FIG. 4 for clarity including gimbal assembly 64, focal plane support structure 67, optical components 68, and RF subsystem 62. As generically illustrated in FIG. 4, guided munition 80 includes a main navigational computer 84, a control actuation system 86, and a plurality of manipulable flight control surfaces 88. Main navigational computer 84, control actuation system 86, and flight control surfaces 88 operate in essentially the same manner as do main navigational computer 50, control actuation system 54, and flight control surfaces 52, respectively, described above in conjunction with FIG. 2. Furthermore, the various manners in which navigational computer 84, control actuation system 86, and flight control surfaces 88 can be implemented and function are well-known in the aerospace and munition industries and will consequently be described only briefly herein. Additional conventionally-known components that may be incorporated into guided munition 80 and which are not shown in FIG. 4 include, but are not limited to, additional guidance components (e.g., global positioning systems and/or inertial navigational systems), power supplies (e.g., battery packs), data links (e.g., a networked radio antenna), one or more warheads, and one or more solid propellant rocket motors or other propulsion devices.

As be seen in FIG. 4, dual function FPA 72 includes two main components: (i) a detector array 90, and (ii) an ROIC 92, 94 positioned immediately behind detector array 90. ROIC 92, 94 includes a first set of circuitry dedicated to image or video processing, which is generically represented in FIG. 4 by block 92 and which is referred to hereafter as "ROIC video processing circuitry 92." ROIC 92, 94 further includes a second set of circuitry dedicated to temporal or pulse processing, which is generically represented in FIG. 4 by block 94 and which is referred to hereafter as "ROIC pulse processing circuitry 94." As indicated in FIG. 4, ROIC video processing circuitry 92 and ROIC pulse processing circuitry 94 can be implemented as two independent or discrete layers, which are joined with detector array 90 in a monolithic, stacked, or laminate arrangement. In alternative embodiments of dual function FPA 72, ROIC video processing circuitry 94 and ROIC pulse processing circuitry 94 can be integrated or combined into a single layer positioned immediately behind detector array 90.

The geometry and number of cells included within detector array 90 will inevitably vary amongst different embodiments of the present invention; however, by way of non-limiting example, detector array 90 may assume the form of a rectangular grid containing $4^2$ to $32^2$ detector cells. Detector array 90 may be fabricated from any suitable material, currently-known or later-developed, that is sensitive to electromagnetic radiation within the one or more bands of the electromagnetic spectrum supportive of both imaging and laser guidance functions. In preferred embodiments, the chosen detector material is sensitive over the majority of, if not the entirety of, the Short Wave Infrared ("SWIR") spectrum; and both imaging and laser guidance functionalities are performed by detection of electromagnetic energy within the SWIR spectrum. Performance of imaging within the SWIR spectrum provides several advantages relative to imaging within the thermal bands (i.e., imaging within the mid- to long-wave infrared bands), as is typically performed by guided munitions equipped with HgCdTe or InSb sensors. These advantages include the elimination of any need for active cooling of the detector array, higher resolutions per aperture size, and an overall reduction in the cost of optics, sensors, and dome materials. Relative to mid- to long-wave infrared energy, SWIR energy typically has a higher transmissivity in maritime environments thereby providing a sensing range advantage when guided munition is launched from an aircraft, surface boat, submarine, or other vessel operating within or near an ocean, sea, or other large body of water. As a still further advantage, conventional seeker dome materials (e.g., sapphire) may become less transmissive to mid- to long-waver infrared energy as they heat during munition flight, especially during flight of high speed (e.g., supersonic) missiles, while the transmissivity of such materials to SWIR energy typically remains largely unaffected by dome heating.

Figure 5:
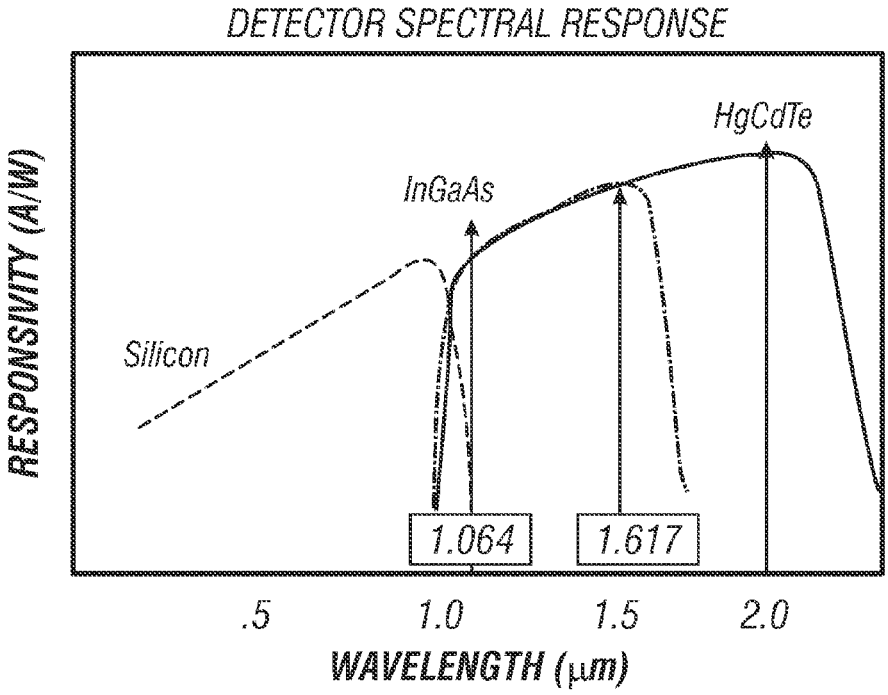
FIG. 5 is a graph of sensor responsivity (vertical axis) versus wavelength (horizontal axis) illustrating the responsivity of an exemplary conventional silicon-based detector and the responsivity of two exemplary detector materials (i.e., Indium-Gallium-Arsenide and Mercury-Cadmium-Telluride) from which the detector array may be fabricated in preferred embodiments of the multi-mode seeker.

Detector array 90 is preferably fabricated utilizing a detector material sensitive to two disparate wavelengths falling within the SWIR spectrum (referred herein as a "dual SWIR band detector material"). While a wide range of detector materials sensitive various different sets of wavelengths within the SWIR spectrum can be utilized, in one preferred embodiment, detector array 90 is fabricated from a dual SWIR band detector material responsive to a first wavelength of approximately 1.06 μm and to a second wavelength of approximately 1.55 μm. By selecting a detector material sensitive to wavelengths of approximately 1.06 μm, compatibility is ensured with 1.06 μm laser designators, which have been widely adopted in conjunction with conventional seekers employing silicon-based detectors. By selecting a detector material that is also sensitive to wavelengths of approximately 1.55 μm, usage is further enabled with next-generation 1.55 μm laser designators, which offer several advantages over currently-adopted 1.06 μm laser designators. As one advantage, 1.55 μm lasers are generally more difficult to detect than are 1.06 μm lasers. As a second advantage, 1.55 μm lasers are considered eye-safe and are consequently better suited for usage within urban combat scenarios. By way of non-limiting example, suitable dual SWIR band detector materials include Indium-Gallium-Arsenide ("InGaAs") and specially-formulated Mercury Cadmium Telluride ("HgCdTe") detector materials. As indicated in FIG. 5, which is a graph of sensor responsivity (vertical axis) versus wavelength (horizontal axis), InGaAs sensors exhibit peak responsivity between approximately 1.064 μm and approximately 1.617 μm and are consequently ideal for detecting wavelengths within the short wave infrared spectrum, including the two wavelengths identified above. As further indicated in FIG. 5, HgCdTe sensors exhibit peak responsivity over a broader range (approximately 1.064 μm to approximately 2.5 μm) and are consequently also well-suited for detecting the above-identified wavelengths, as well as longer wavelengths within the SWIR spectrum. To provide a basis for comparison, the responsivity of a conventionally-known silicon-based detector (referred to herein simply as a "silicon detector") is also shown in FIG. 5. As can be seen, the silicon detector exhibits a peak responsivity near 1.0 μm and is substantially less responsive to wavelengths exceeding approximately 1.064 μm. The foregoing examples notwithstanding, it is emphasized that preferred embodiments of the multi-mode seeker can include detector arrays fabricated from detector materials, whether currently known or later developed, responsive to any wavelength or set of wavelengths within the SWIR spectrum (approximately 0.9 μm to approximately 2.5 μm).

Figure 6:
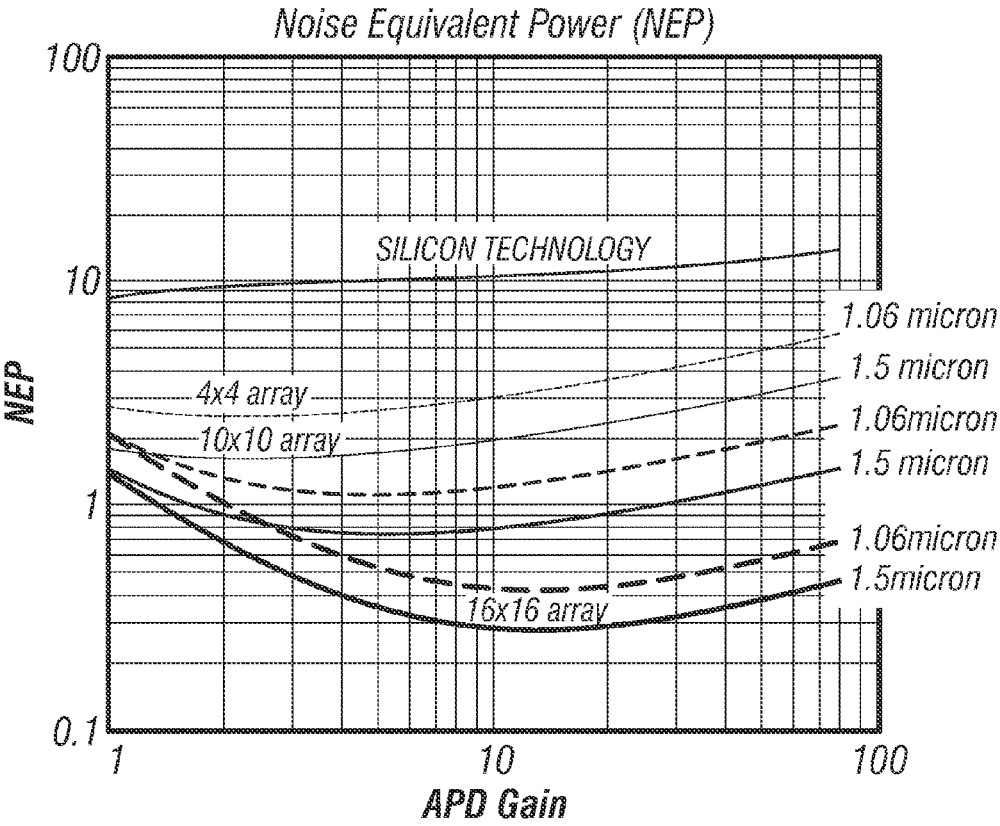
FIG. 6 is a graph of Noise Equivalent Power (vertical axis) versus Avalanche Photodetector (APD) gain (horizontal axis) illustrating the sensitivity profile of an exemplary conventional silicon-based detector compared to the sensitivity profiles of several InGaAs sensors of varying array sizes.

Advantageously, the InGaAs or HgCdTe sensor included within preferred embodiments of seeker 60 achieves relatively high quantum efficiency (e.g., approaching or exceeding 90%) as compared to conventional silicon detectors of the type described above, which tend to have quantum efficiencies closer to approximately 40%. This may be more fully appreciated by referring to FIG. 6, which is a graph of Noise Equivalent Power (vertical axis) versus Avalanche Photodetector ("APD") gain (horizontal axis) illustrating the sensitivity profile of an exemplary conventional silicon-based detector compared to the sensitivity profiles of InGaAs sensors of varying array sizes ($4^2$ to $32^2$). Similar quantum efficiencies can also be achieved utilizing HgCdTe sensors of corresponding array sizes. In addition, due, at least in part, to a more focused instrument field of view, InGaAs or HgCdTe sensors (or other such dual SWIR band sensors) are significantly less sensitive to solar background noise as compared to conventional silicon detectors. As a result, employment of InGaAs or HgCdTe sensors can enable a reduction in aperture and/or designator power without a corresponding loss of performance.

During operation of multi-mode seeker 60, ROIC video processing circuitry 94 provides bi-modal processing system 74 with signals indicative of the irradiance across detector array 90, while ROIC pulse processing circuitry 94 provides processing system 74 with signals indicative of laser pulse energy detected by array 90. When operating in the imaging mode, bi-modal processing system 74 generates video data as a function of signals received from ROIC video processing circuitry 94 and supplies the video data to main navigational computer 84. Conversely, when operating in the SAL guidance mode, processing system 74 generates line-of-sight data as a function of signals received from ROIC pulse processing circuitry 94 and supplies line-of-sight data to main navigational computer 84. When operating in the SAL guidance mode, processing system 74 generates line-of-sight data based upon only those signals that are indicative of laser pulse energy that has been verified or qualified as corresponding to at least one predetermined laser designator. To qualify detected laser pulse signals as originating from a predetermined laser designator, the optical signals detected by array 90 are analyzed by ROIC circuitry 94 and/or processing system 74 to first measure certain features of the detector laser pulses (commonly referred to herein as "pulse feature extraction") and to subsequently compare the extracted pulse features to expected values associated with the predetermined laser designator. Pulse feature extraction and qualification can be performed in the analog circuitry of ROIC circuitry 94, in the digital circuitry of processing system 74, or a combination thereof, as described more fully below in conjunction with FIGS. 7-10.

Figure 7:
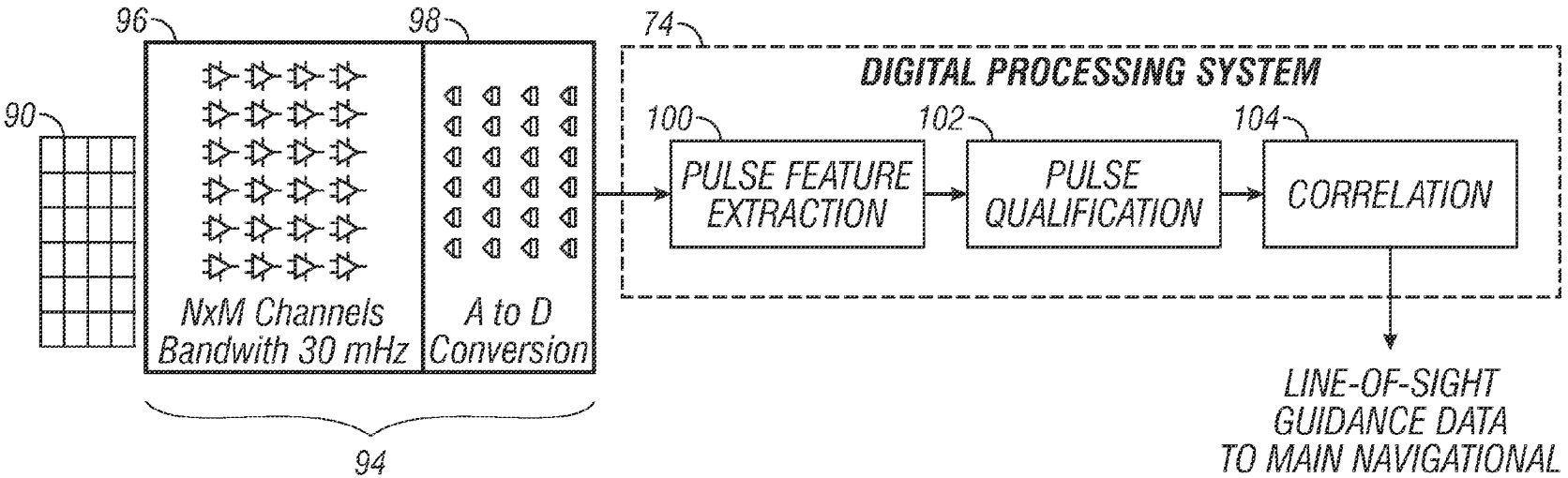
FIGS. 7-10 are simplified block diagrams illustrating several exemplary manners in which the processing components of the tri-mode seeker shown in FIG. 4 can be configured to provide pulse detection, feature extraction, qualification, and correlation when the tri-mode seeker is operating in a SAL guidance mode.

FIG. 7 is a simplified block diagram illustrating a first exemplary implementation of ROIC pulse processing circuitry 94 and bi-modal processing system 74 wherein pulse feature extraction and pulse qualification is performed solely by processing system 74. As generically illustrated in FIG. 7, ROIC pulse processing circuitry 94 includes an array of laser pulse-sensitive preamplifiers 96 and analog-to-digital ("A/D") converters 98; while digital processing system 74 includes pulse feature extraction circuitry 100, pulse qualification circuitry 102, and correlation circuitry 104. ROIC preamplifiers 96 are each operatively coupled to a different cell included within detector array 90, and A/D converters 98 are each operatively coupled to a different one of preamplifiers 96. The outputs of A/D converters 98 are, in turn, coupled to inputs of processing system 74 and, specifically, to inputs of pulse feature extraction processing 100. Pulse feature extraction circuitry 100 is coupled, in processing series, with pulse qualification processing 102 and correlation processing 104. During operation of bi-modal processing system 74, pulse feature extraction processing 100 cooperates with pulse qualification processing 102 and correlation processing 104 to sequentially process data provided by ROIC circuitry 94 pertaining to laser pulse signals registered by detector array 90, as further described below. In one embodiment, digital processing system 74 is implemented as an interface board populated with at least one field programmable gate array and at least one digital signal processor. Although other implementations are possible, pulse feature extraction processing 100, pulse qualification processing 102, and correlation processing 104 are preferably implemented as one or more algorithms utilizing field programmable gate array programming (firmware) and/or as software programming.

When bi-modal processing system 74 is operating in a SAL guidance mode, pulse feature extraction processing 100 first determines whether the digital inputs signals provided by A/D converters 98 are indicative of detected pulses and, if so, processing 100 then measures or extracts data indicative of various features of the detected laser pulses. These features may include, but are not limited to, pulse detection, rise time, fall time, amplitude, and time of arrival, pixel address, and noise. Pulse feature extraction processing 100 then outputs digital signals indicative of the extracted pulse features to pulse qualification processing 102, which analyzes the extracted pulse feature data to determine if the detected laser pulses correspond to a predetermined laser designator. In one embodiment, pulse qualification processing 102 determines if the detected laser pulses correspond to the predetermined designator by comparing the amplitude, time of arrival, and/or the pixel address of the detected laser pulses to expected values. If the features of the detected laser pulse are determined to correspond to the predetermined designator, correlation processing 104 then processes the data received from pulse qualification processing 102 to generate line-of-sight data (e.g., pitch and yaw angles) indicating the location of seeker 60 relative to the designated target from which the laser pulses were reflected. As will be appreciated by one of ordinary skill in the industry, various different processing techniques can be utilized to generate line-of-sight data as a function of the extracted and qualified pulse feature data provided by pulse qualification processing 102 including, for example, a last pulse/first pulse logic. Correlation processing 104 then outputs the line-of-sight data to main navigational computer 84 (FIG. 4), which utilizes the data to determine the appropriate guidance adjustments to flight control surfaces 88 to provide inflight guidance to munition 80 in the manner previously described.

The foregoing has thus provided one exemplary manner in which ROIC pulse processing circuitry 94 and processing system 74 can be implemented wherein the primary function of ROIC pulse processing circuitry 94 is to sample or digitize all optical signals registered across detector array 90. Processing system 74 then performs pulse detection, feature extraction, pulse qualification, and correlation functions in the above-described manner to generate the desired line-of-sight guidance data. While certainly feasible, the above-described exemplary implementation places considerable processing demands on processing system 74. The processing demands placed on bi-modal processing system 74 can, however, be significantly reduced by providing ROIC circuitry 94 with analog circuitry that first determines whether the optical signals registered by detector array 90 are indicative of detected laser pulses prior to relaying data to processing system 74 for further processing. To further illustrate this point, a second exemplary implementation of ROIC pulse processing circuitry 94 and bi-modal processing system 74 wherein ROIC circuitry 94 further performs a pulse detection function is described below in conjunction with FIG. 8.

Figure 8:
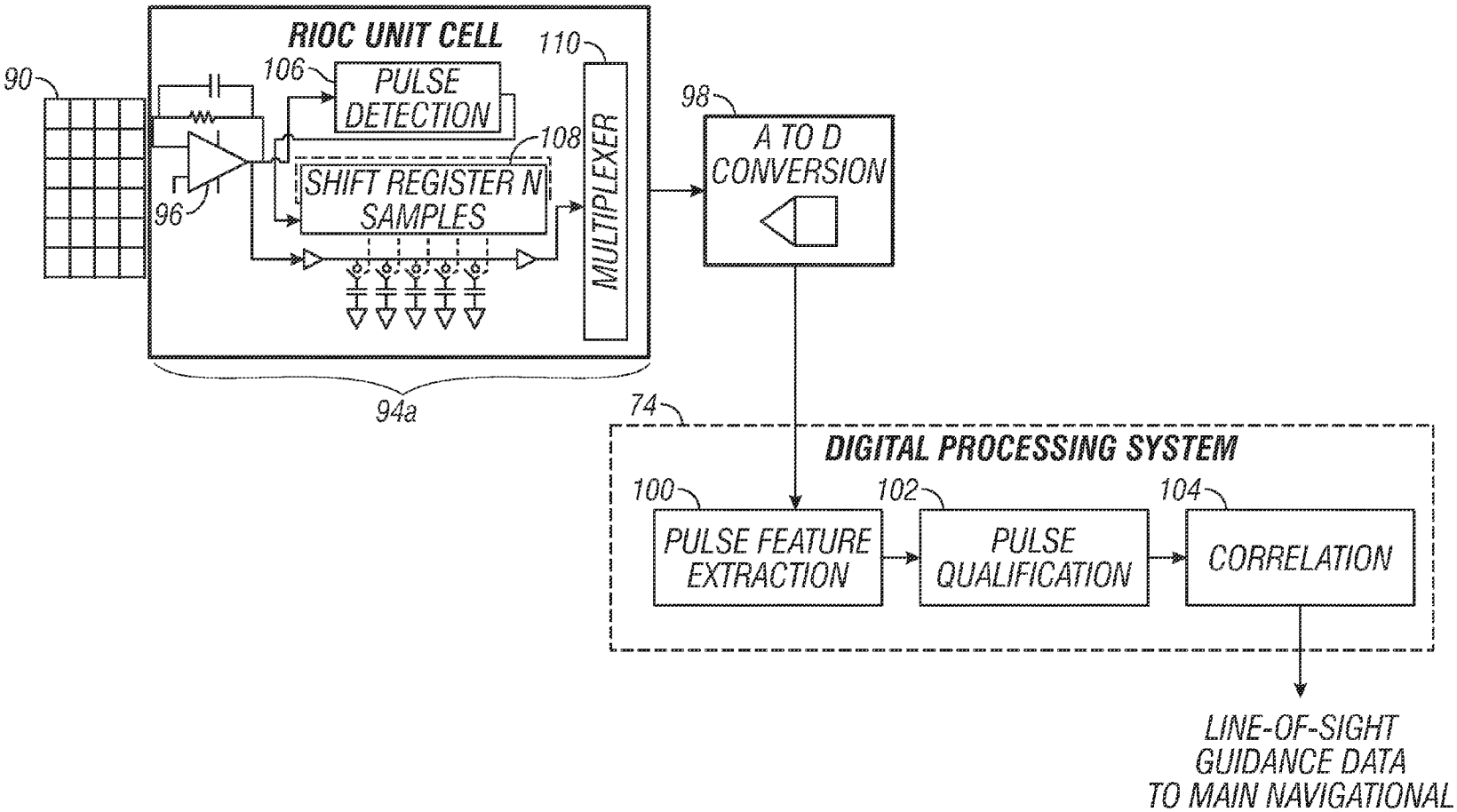

FIG. 8 is a simplified block diagram illustrating a second exemplary implementation of ROIC pulse processing circuitry 94 and bi-modal processing system 74. In the exemplary implementation shown in FIG. 8, each ROIC cell 94(*a*) (only one of which is shown in FIG. 8) includes analog pulse detection circuitry 106, a shift register 108, and a multiplexer 110 in addition to a preamplifier 96 and A/D converter 98. Analog pulse detection circuitry 106 includes an input, which is coupled to preamplifier 96, and an output, which is coupled to a first input of shift register 108. A second input of shift register 108 is coupled to an output of preamplifier 96, and an output of shift register 108 is coupled to multiplexer 110. During operation, pulse detection circuitry 106 compares the signal provided by preamplifier 96 to a predetermined threshold value. If the preamplifier signal surpasses the threshold value, pulse detection circuitry 106 signals shift register 108 to record the signal's value around the detected pulse and transfer the signals to multiplexer 110. In this manner, shift register 108 stores only data pertaining to detected laser pulse signals. Multiplexer 110 then transmits the output signal values to A/D converter 98, which provides a corresponding digital signals to pulse feature extraction processing 100 of digital processing system 74. Digital processing system 74 then performs pulse feature extraction, qualification, and correlation in the above-described manner. In this manner, ROIC circuitry 94 serves as a data gate, which transmits data to digital processing system 74 only after determining that laser pulse signals have been detected. In so doing, ROIC circuitry 94 greatly reduces the processing demands placed on processing system 74.

Figure 9:
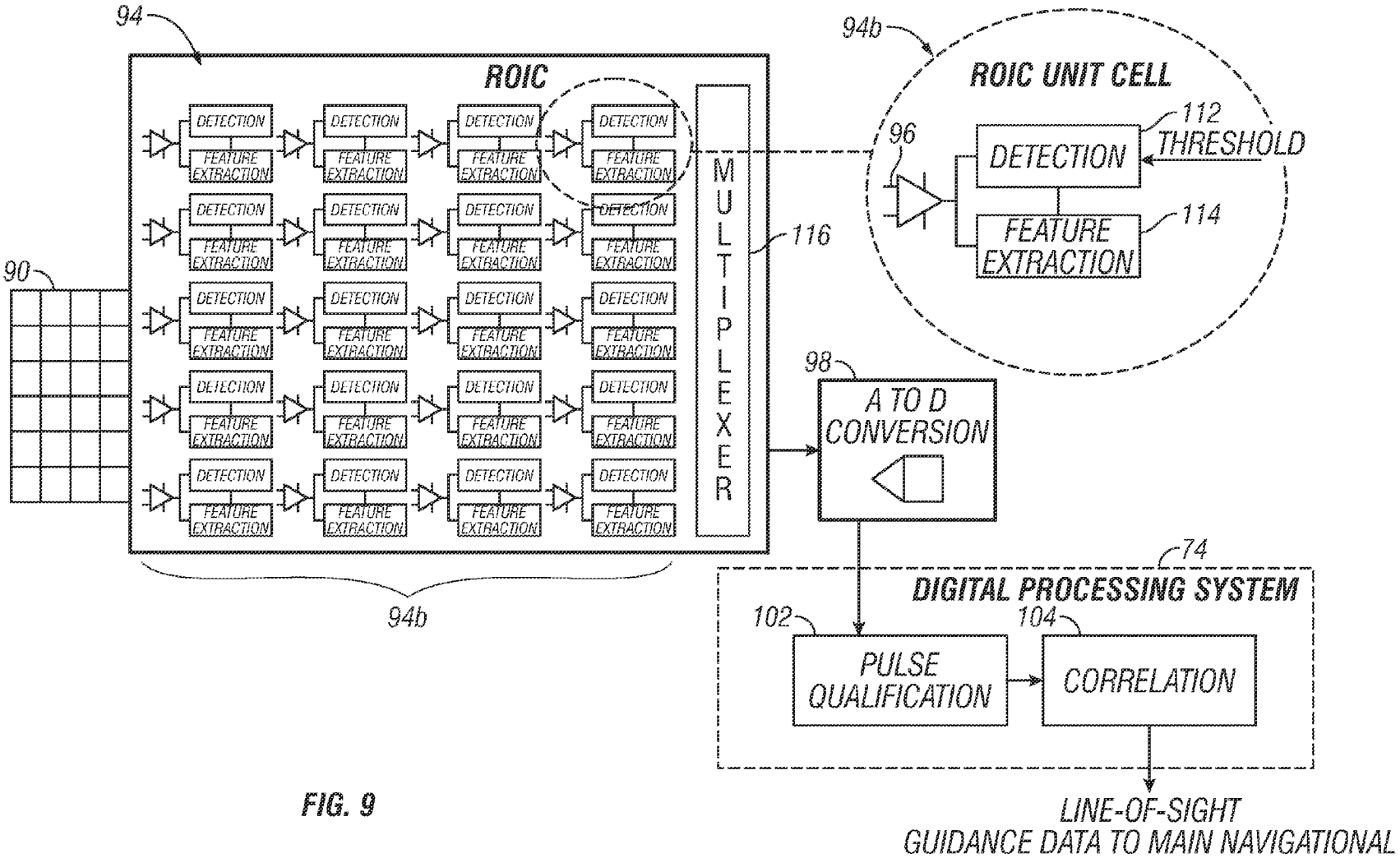

FIG. 9 is a simplified block diagram illustrating a third exemplary implementation of ROIC pulse processing circuitry 94 and bi-modal processing system 74 wherein pulse detection and feature extraction is performed by ROIC circuitry 94 and wherein pulse qualification and correlation is performed by processing system 74. As was the case previously, ROIC circuitry 94 includes a number of cells 94(*b*), each corresponding to a different cell of detector array 90 (only a limited number ROIC cells 94(*b*) are shown in FIG. 9 for clarity). In the exemplary embodiment illustrated in FIG. 9, each ROIC cell 94(*b*) includes a laser pulse-sensitive preamplifier 96; pulse detection circuitry 112, which is coupled to an output of its corresponding preamplifier 96; and feature extraction circuitry 114, which is likewise coupled to an output of its corresponding preamplifier 96. During operation, analog pulse detection circuitry 112 compares the input signals provided by preamplifier 96 to a predetermined threshold value. If the input signals provided by preamplifier 96 surpass the threshold value, it is determined that the inputs signals are indicative of detected laser pulses, and pulse detection circuitry 112 relays the input signals to pulse feature extraction circuitry 114. Pulse feature extraction circuitry 114 then measures various parameters of the input signals provided by preamplifier 96 and supplies corresponding data to a multiplexer 116. Multiplexer 116 then applies the analog signals provided by each of the ROIC cells with the appropriate pixel address to an A/D converter 98, which provides a corresponding digital signal to processing system 74. As pulse detection and feature extraction has already been performed by ROIC circuitry 94, processing system 74 need only include pulse qualification processing 102 and correlation processing 104, which qualify and correlate the incoming laser pulses signals, respectively, as previously described. By moving pulse feature detection and extraction into the analog domain of the ROIC unit cell, the processing demands place on processing system 74 are further reduced. As an additional benefit, the data rate applied to processing system 74 does not increase with an increase in array size and is, instead, determined by the number of detected laser pulses and the number of extracted features per detected laser pulse.

Figure 10:
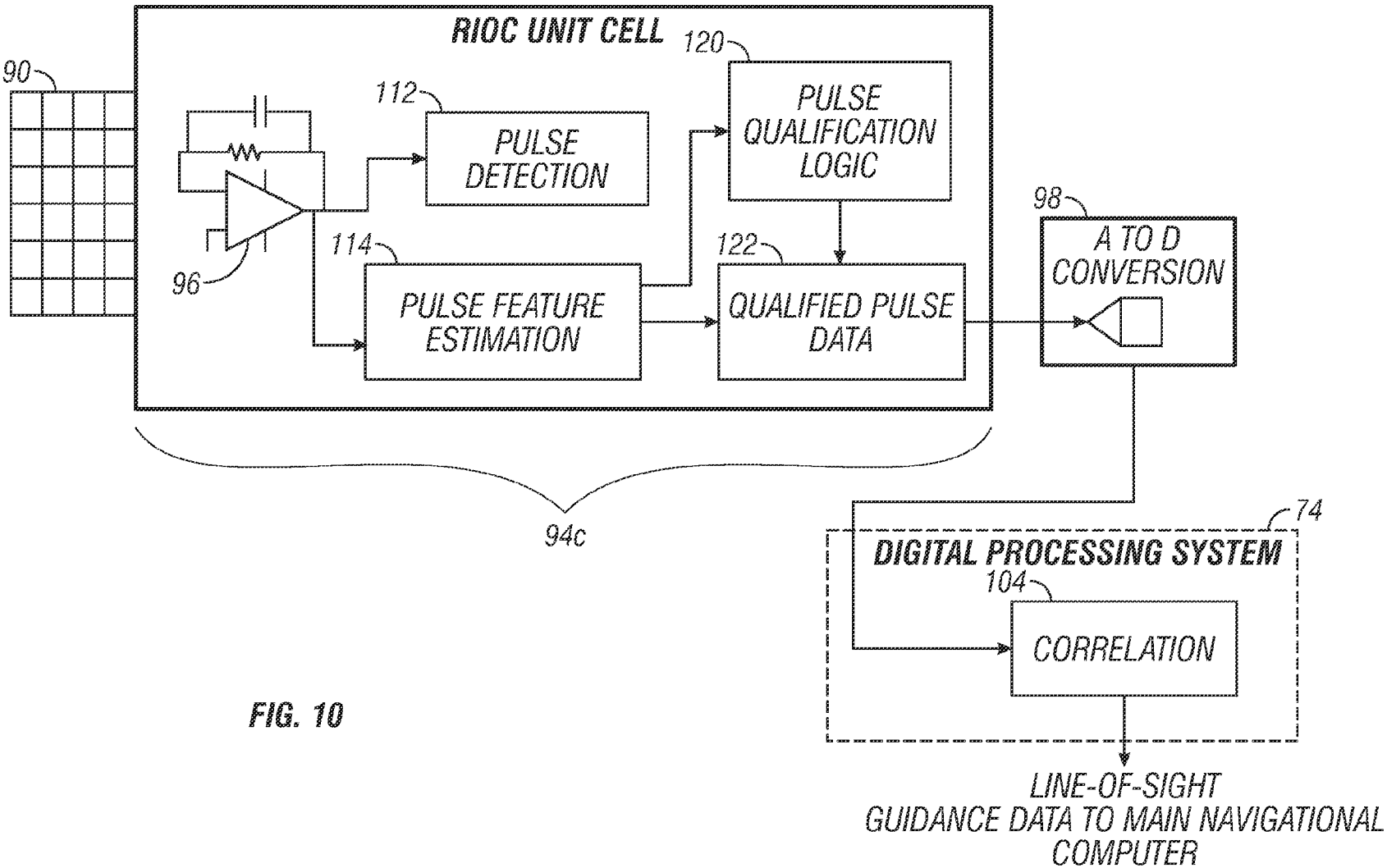

FIG. 10 is a simplified block diagram illustrating a fourth exemplary implementation of ROIC pulse processing circuitry 94 and bi-modal processing system 74 wherein pulse feature extraction and pulse qualification are performed entirely by ROIC circuitry 94. In this case, each ROIC cell 94(*c*) (only one of which is shown in FIG. 10) includes pulse detection circuitry 112, pulse feature extraction circuitry 114, pulse qualification logic 120, and qualified pulse data gate 122 in addition to preamplifier 96 and A/D converter 98. Preamplifier 96, pulse detection circuitry 112, and pulse feature extraction circuitry 114 function in essentially the same manner as described above in conjunction with FIG. 9. However, in contrast to the above-described exemplary embodiment, the output of pulse feature extraction circuitry 114 is not applied directly to A/D converter 98. Instead, the output of pulse feature extraction circuitry 114 is applied to pulse qualification logic 120 and to a qualified pulse data gate 122. During operation of ROIC cell 94(*c*), pulse qualification logic 120 analyzes the extracted pulse feature data provided by pulse feature extraction circuitry 114 to determine if the extracted pulse feature data corresponds to the predetermined laser designator or laser designators. If the extracted pulse feature data corresponds to the predetermined laser designator, pulse qualification logic 120 sends an appropriate signal to qualified pulse data gate 122, which then transmits the qualified pulse feature data to A/D converter 98. A/D converter 98 then applies a corresponding digital signal to bi-modal processing system 74, which correlates the qualified pulse feature data to generate the desired line-of-sight guidance data in the manner previously described.

The foregoing has thus described several exemplary embodiments of a multi-mode seeker (e.g., tri-mode seeker 60 shown in FIGS. 3 and 4) operable in both semi-active laser and image tracking guidance modes. In preferred embodiments, the default or starting mode of tri-mode seeker 60 is the SAL guidance mode, and seeker 60 switches or is caused to switch to the imaging tracking mode after target acquisition or lock-on. During an exemplary targeting sequence, a target may first be designated by anointment with a predetermined laser designator. A guided missile or other munition carrying seeker 60 may then be launched. Seeker 60, initially operating in a SAL guidance mode, detects the pulsed laser energy reflected from the designated target. After verifying the pulsed laser energy as emitted from a qualified laser designator, seeker 60 may then lock-on to the target reflecting the pulsed laser energy. After target lock-on, seeker 60 switches or is switched into the image guidance mode. In one embodiment, seeker 60 transmits a signal indicating that SAL lock-on has been achieved to a remote command source (e.g., a pilot of an aircraft), and the remote command source then transmits a command signal to seeker 60 to switch in the image tracking mode. In such a case, guided munition 80 may receive the wireless command signal via a receiver or transceiver operatively coupled to main navigational computer 84, as generally indicated in FIG. 4 at 130. In a second embodiment, seeker 60 may automatically switch into the image tracking mode after target lock-on has been achieved. In this latter case, seeker 60 may simultaneously transmit a signal to a remote command source (e.g., a pilot of an aircraft) indicating that the seeker is now operating in an image guidance mode. After seeker 60 has transitioned to the image guidance mode, anointment of the designated target by the laser designator is no longer required as seeker 60 will now track the image previously designated by laser anointment. Thus, in contrast to munition requiring continued laser input until target impact, the operator of the laser designator (e.g., on-the-ground personnel or a neighboring aircraft) is now freed to relocate and designate a new target, as desired. Switching of seeker 60, and specifically of digital processing system 74 (FIG. 4), can be achieved in a relatively straightforward manner by switching between high and low inputs each corresponding to a different guidance mode on a single bit control line of processing system 74 (represented in FIG. 4 by arrow 132).

There has thus been provided multiple exemplary embodiments of a multi-mode seeker, such as a dual- or tri-mode seeker, operable in both Semi-Active Laser and image tracking guidance modes. In contrast to traditional multi-mode seekers having image tracking and SAL guidance capabilities, embodiments of the above-described multi-mode seeker utilize a single optical train, a single focal plane array, and a single processing train to perform both image and SAL tracking functionalities. As a result, embodiments of the multi-mode seeker have a reduced complexity, part count, weight, envelope, and cost. At the same time, reliability and guidance accuracy of the above-described multi-mode seekers is also maintained or improved relative to conventional seekers due, in certain embodiments, to the usage of a high resolution SWIR detector array to provide SAL guidance. Several exemplary implementations of the manner in which the seeker may be configured to perform pulse feature extraction, qualification, and correlation when operating in a SAL guidance mode have also been provided.

While at least one exemplary embodiment has been presented in the foregoing Detailed Description, it should be appreciated that a vast number of variations exist. It should also be appreciated that the exemplary embodiment or exemplary embodiments are only examples, and are not intended to limit the scope, applicability, or configuration of the invention in any way. Rather, the foregoing Detailed Description will provide those skilled in the art with a convenient road map for implementing an exemplary embodiment of the invention. It being understood that various changes may be made in the function and arrangement of elements described in an exemplary embodiment without departing from the scope of the invention as set-forth in the appended Claims.

What is claimed is:

1. A multi-mode seeker configured to be utilized in conjunction with a predetermined laser designator, the multi-mode seeker comprising:

a focal plane array, comprising:

a detector array; and a Read-Out Integrated Circuit (ROIC) operatively coupled to the detector array; and a bi-modal processing system operatively coupled to ROIC and switchable between: (i) an imaging mode wherein the bi-modal processing system generates video data as a function of signals received from ROIC indicative of irradiance across the detector array, and (ii) a semi-active laser guidance mode wherein the bi-modal processing system generates line-of-sight data as a function of signals received from ROIC indicative of laser pulses detected by the detector array and qualified as corresponding to the predetermined laser designator.

2. A multi-mode seeker according to claim 1 wherein the ROIC comprises:

video processing circuitry coupled to a first input of the bi-modal processing system; and laser pulse processing circuitry coupled to a second input of the bi-modal processing system.

3. A multi-mode seeker according to claim 2 wherein the ROIC further comprises:

a first ROIC layer containing the video processing circuitry; and a second ROIC layer containing the laser pulse processing circuitry, the first ROIC layer, the second ROIC layer, and the detector array joined together in a laminate arrangement.

4. A multi-mode seeker according to claim 2 wherein the laser pulse processing circuitry is configured to: (i) determine if laser pulse signals has been registered by at least one cell of the detector array, and (ii) transmit data to the bi-modal processing system indicative the laser pulse signals registered by the at least one cell.

5. A multi-mode seeker according to claim 4 wherein the laser pulse processing circuitry is further configured to: (i) extract pulse feature data describing at least one feature of the laser pulse signals registered by the at least one cell, and (ii) provide to the bi-modal processing system the pulse feature data.

6. A multi-mode seeker according to claim 5 wherein the pulse feature data comprises at least one of the group consisting of rise time, fall time, amplitude, and time of arrival.

7. A multi-mode seeker according to claim 5 wherein the laser pulse processing circuitry is further configured to qualify the laser pulse signals registered by the at least one cell as corresponding to the predetermined laser designator utilizing the extracted pulse feature data.

8. A multi-mode seeker according to claim 1 wherein the multi-mode seeker further comprises:

a seeker dome; and at least one optical element configured to guide laser energy and infrared radiation received through the seeker dome along a common optical path to the detector array.

9. A multi-mode seeker according to claim 1 wherein the detector array is responsive to energy within the short wavelength infrared spectrum, wherein the video processing circuitry is configured to process optical signals indicative of the irradiance received across the detector array within the short wavelength infrared spectrum, and wherein the laser pulse processing circuitry is configured to process optical signals indicative of laser pulse signals registered by the detector array within the short wavelength infrared spectrum.

10. A multi-mode seeker according to claim 1 wherein the detector array comprises a detector material responsive to wavelengths of approximately 1.064 microns and to approximately 1.617 microns, and wherein the laser pulse processing circuitry is configured to process optical signals indicative of laser pulse signals registered by the detector array corresponding wavelengths of approximately 1.064 microns and to approximately 1.617 microns.

11. A multi-mode seeker according to claim 1 wherein the processing system operates in the semi-active laser guidance mode by default.

12. A multi-mode seeker according to claim 1 wherein the multi-mode seeker is configured to be utilized in conjunction with a main navigational computer, and wherein the bi-modal processing system is configured to switch from the semi-active laser guidance mode to the image guidance mode in response to input received from the main navigational computer.

13. A multi-mode seeker, comprising:

a focal plane array, comprising:

a detector array; and a Read-Out Integrated Circuit (ROIC) operatively coupled to the detector array; and a bi-modal processing system operatively coupled to ROIC and switchable between an imaging mode and a semi-active laser guidance mode;

wherein the ROIC comprises: (i) video processing circuitry coupled to a first input of the bi-modal processing system and configured to generate signals indicative of irradiance across the detector array, and (ii) laser pulse processing circuitry coupled to a second input of the bi-modal processing system and configured to provide data to bi-modal processing system indicative of laser pulse signals detected by the detector array.

14. A multi-mode seeker according to claim 13 wherein the laser pulse processing circuitry is further configured to extract pulse feature data describing at least one feature of the registered laser pulse signals.

15. A multi-mode seeker according to claim 14 wherein multi-mode seeker is configured to be utilized in conjunction with a predetermined laser designator, and wherein the laser pulse processing circuitry is further configured to qualify the laser pulse signals registered by the at least one cell as corresponding to the predetermined laser designator utilizing the extracted pulse feature data.

16. A guided munition configured to be utilized in conjunction with a predetermined laser designator, the guided munition comprising:

a multi-mode seeker, comprising:

a focal plane array including a detector array and a Read-Out Integrated Circuit (ROIC) operatively coupled to the detector array;

a bi-modal processing system operatively coupled to ROIC and switchable between: (i) an imaging mode wherein the bi-modal processing system generates video data as a function of signals received from ROIC indicative of irradiance across the detector array, and (ii) a semi-active laser guidance mode wherein the bi-modal processing system generates line-of-sight data as a function of signals received from ROIC indicative of laser pulses registered by the detector array and qualified as corresponding to the predetermined laser designator; and a main navigational computer coupled to an output of the bi-modal processing system and configured to receive therefrom video data when the bi-modal processing system is operating in the imaging mode and line-of-sight data when the bi-modal processing system is operating in the semi-active laser guidance mode.

17. A guided munition according to claim 16 wherein the bi-modal processing system normally operates in the semi-active laser guidance mode, and wherein the main navigational computer is configured to command the bi-modal processing system to switch from the semi-active laser guidance mode to the imaging mode during munition flight.

18. A guided munition according to claim 17 wherein the main navigational computer is configured to command the bi-modal processing system to switch from the semi-active laser guidance mode to the imaging mode during munition flight when determining that target lock-on has been achieved in the semi-active laser guidance mode.

19. A guided munition according to claim 18 wherein the guided munition further comprises a wireless transmitter coupled to the main navigational computer, and wherein the main navigational computer is configured to transmit a signal via the wireless transceiver indicating when target lock-on has been achieved in the semi-active laser guidance mode.

20. A guided munition according to claim 17 wherein the guided munition further comprises a wireless receiver coupled to the main navigational computer, and wherein the main navigational computer is configured to command the bi-modal processing system to switch from the semi-active laser guidance mode to the imaging mode in response to receipt of a command signal by the wireless receiver.

* * * * *